US009260273B2

(12) United States Patent
Mizuno

(10) Patent No.: US 9,260,273 B2
(45) Date of Patent: Feb. 16, 2016

(54) SHEET CONVEYANCE APPARATUS AND IMAGE FORMING APPARATUS

(71) Applicant: CANON KABUSHIKI KAISHA, Tokyo (JP)

(72) Inventor: Tatsubumi Mizuno, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/951,172

(22) Filed: Jul. 25, 2013

(65) Prior Publication Data

US 2014/0027975 A1 Jan. 30, 2014

(30) Foreign Application Priority Data

Jul. 30, 2012 (JP) ..... 2012-168144

(51) Int. Cl.
*B65H 29/58* (2006.01)
*B65H 85/00* (2006.01)
*B65H 29/60* (2006.01)

(52) U.S. Cl.
CPC ..... *B65H 85/00* (2013.01); *B65H 29/58* (2013.01); *B65H 29/60* (2013.01); *B65H 2401/10* (2013.01); *B65H 2404/5214* (2013.01); *B65H 2404/63* (2013.01); *B65H 2404/632* (2013.01); *B65H 2801/06* (2013.01)

(58) Field of Classification Search
CPC ... B65H 29/58; B65H 29/60; B65H 2404/632
USPC ..... 271/303
See application file for complete search history.

(56) References Cited

U.S. PATENT DOCUMENTS

| | | | | |
|---|---|---|---|---|
| 6,764,236 | B2 * | 7/2004 | Suzuki | 400/642 |
| 7,334,687 | B2 * | 2/2008 | Yurko | 209/652 |
| 8,231,126 | B2 * | 7/2012 | Shimonaga | 271/304 |
| 2004/0144697 | A1 * | 7/2004 | Ramonowski | 209/652 |
| 2004/0251609 | A1 * | 12/2004 | Taniguchi | 271/225 |

FOREIGN PATENT DOCUMENTS

| | | | |
|---|---|---|---|
| JP | 2001180860 A | * | 7/2001 |
| JP | 2001240287 A | * | 9/2001 |
| JP | 2001302059 A | * | 10/2001 |
| JP | 2012-86920 A | | 5/2012 |

* cited by examiner

*Primary Examiner* — Luis A Gonzalez
(74) *Attorney, Agent, or Firm* — Canon USA Inc. IP Division

(57) ABSTRACT

A sheet conveyance apparatus includes a first path and a second path through which a sheet is conveyed, and a guide portion rotatable between a first position where the sheet is guided to the first path and a second position where the sheet is guided to the second path, wherein the guide portion includes a resin member including a first guide surface configured to guide the sheet to the first path at the first position, and a second guide surface configured to guide the sheet to the second path at the second position, and a reinforcing member including a main body portion extending in a direction along an axis line of guide portion, and protrusions protruding, along the first guide surface and the second guide surface, from both end portions in a longitudinal direction of the main body portion.

27 Claims, 15 Drawing Sheets

SHEET CONVEYANCE APPARATUS AND IMAGE FORMING APPARATUS

BACKGROUND OF THE INVENTION

1. Field of the Invention

The present invention relates to a sheet conveyance apparatus configured to convey sheets and to an image forming apparatus equipped with the sheet conveyance apparatus.

2. Description of the Related Art

Nowadays, there is a demand for a further reduction in the size of image forming apparatuses for the purpose of space saving or the like. For example, there is a tendency for a switching member configured to switch sheet conveyance paths at a branching position in the sheet conveyance path to be reduced in thickness.

The switching member has two guide surfaces. In order that no step may be formed in the sheet conveyance direction with respect to an upstream or a downstream guide member to be connected to the guide surfaces, the two guide surfaces are required to have a complicated configuration for smooth connection with comb-teeth-like overlapping. In view of this, the switching member is generally formed not of metal material but of resin material (refer to Japanese Patent Application Laid-Open No. 2012-86920).

However, when the switching member is formed of resin material and the thickness of the switching member is reduced, there is a problem of a shortage of bending rigidity, thus resulting in instability in configuration. For example, when there is a variation in a distal end position due to deflection or torsion caused by the weight of the switching member itself, the switching member may protrude with respect to the upstream or downstream guide surface overlapped in a comb-teeth-like manner. That results in generation of a step in the sheet conveyance direction, which will catch the leading edges of the sheets.

SUMMARY OF THE INVENTION

The present invention is directed to a sheet conveyance apparatus enabling stable conveyance of sheets and to an image forming apparatus equipped with the sheet conveyance apparatus.

According to an aspect of the present invention, a sheet conveyance apparatus includes a first path and a second path through which a sheet is conveyed, and a guide portion rotatable between a first position where the sheet is guided to the first path and a second position where the sheet is guided to the second path, wherein the guide portion includes a resin member including a first guide surface configured to guide the sheet to the first path at the first position, and a second guide surface configured to guide the sheet to the second path at the second position, and a reinforcing member including a main body portion extending in a direction along an axis line of the guide portion, and protrusions protruding, along the first guide surface and the second guide surface, from both end portions in a longitudinal direction of the main body portion.

Further features of the present invention will become apparent from the following description of exemplary embodiments with reference to the attached drawings.

DESCRIPTION OF THE EMBODIMENTS

In the following, an image forming apparatus according to exemplary embodiments of the present invention will be described with reference to FIGS. 1 through 13A, 13B, and 13C. The image forming apparatus according to the exemplary embodiments of the present invention is an image forming apparatus equipped with a sheet conveyance unit as a sheet conveyance apparatus, including a switching member capable of switching sheet conveyance paths, such as a copying machine, a printer, a facsimile apparatus, or a multifunction peripheral of these. In the exemplary embodiments described below, an electrophotographic image forming apparatus (hereinafter, referred to as the "image forming apparatus") configured to form a four-color toner image is described as an example.

Figure 1:
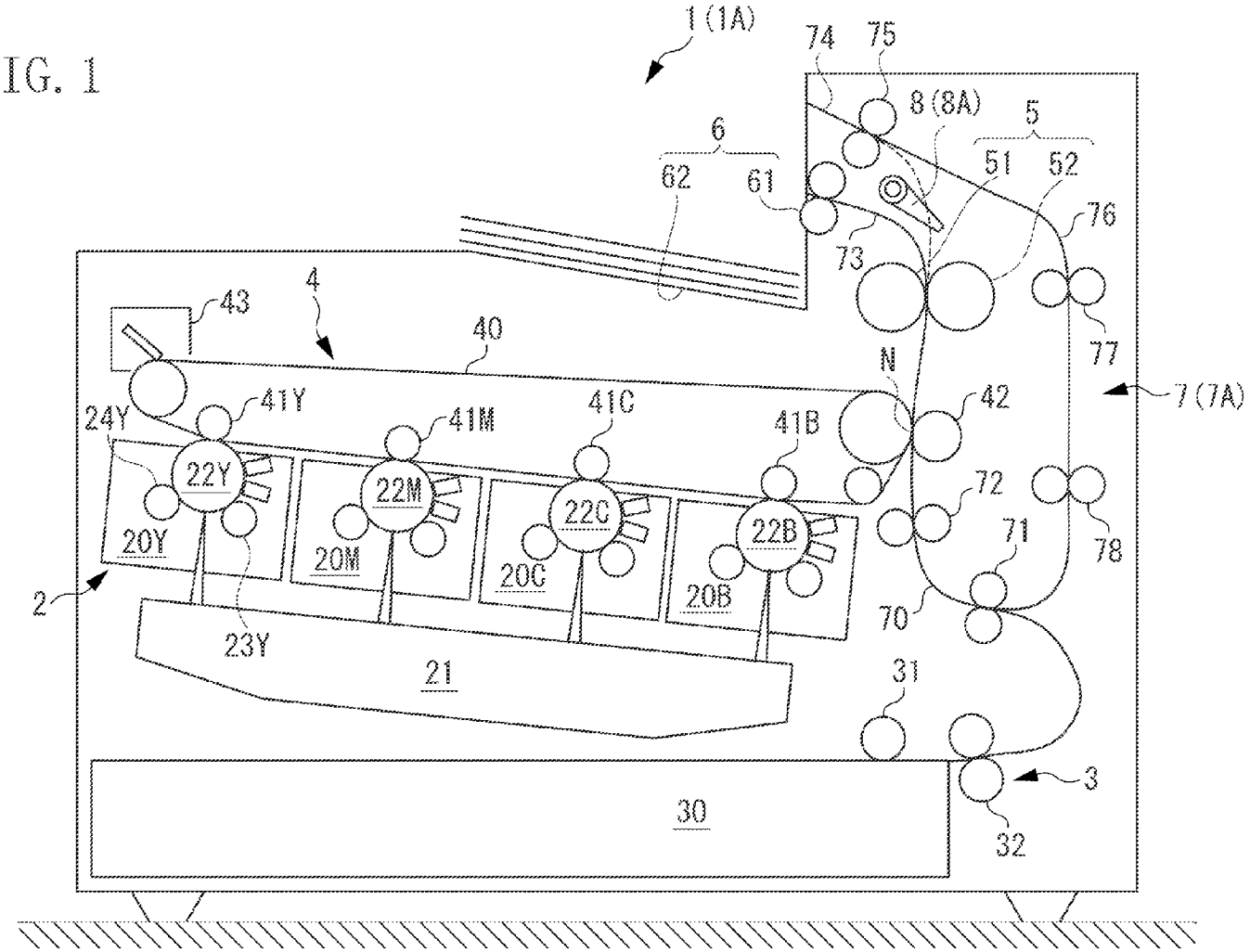
FIG. 1 is a sectional view schematically illustrating an overall configuration of an image forming apparatus according to an exemplary embodiment of the present invention.
Figure 2:
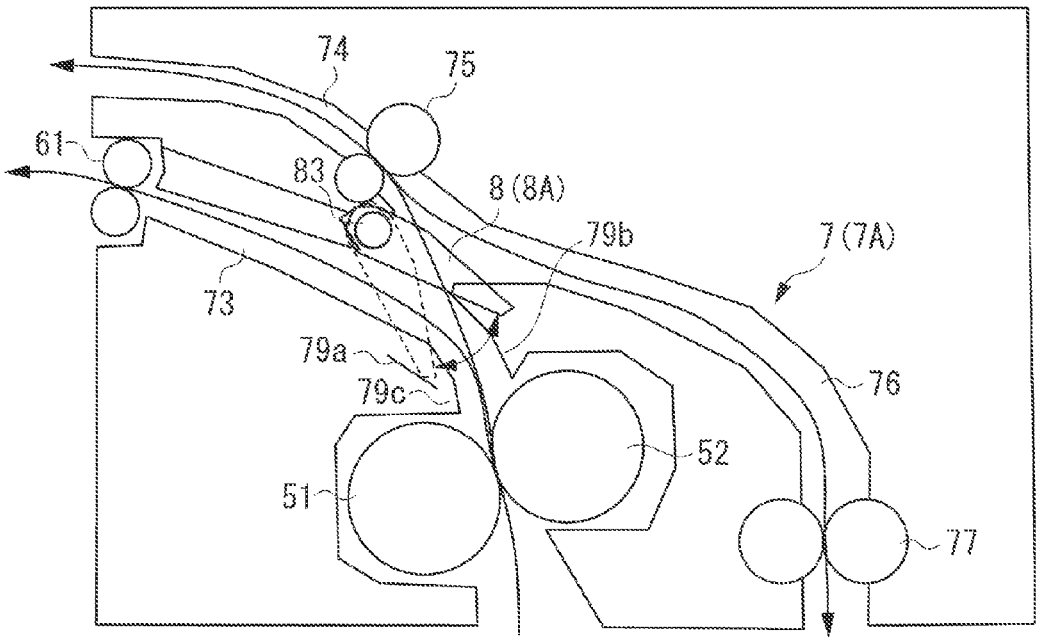
FIG. 2 is a sectional view illustrating a branching position in a sheet conveyance unit according to a first exemplary embodiment.

An image forming apparatus according to a first exemplary embodiment of the present invention will be described with reference to FIGS. 1 through 7. First, the overall configuration of an image forming apparatus 1 according to the first exemplary embodiment will be described with reference to FIGS. 1 and 2. FIG. 1 is a sectional view schematically illustrating the entire configuration of the image forming apparatus 1 according to the exemplary embodiment of the present invention. FIG. 2 is a sectional view illustrating a branching position in a sheet conveyance unit 7 according to the first exemplary embodiment.

As illustrated in FIG. 1, the image forming apparatus 1 includes an image forming unit 2 for forming an image, a sheet feeding unit 3 for feeding a sheet, and a transfer unit 4 for transferring the image to the sheet. Further, the image forming apparatus 1 includes a fixing unit 5 for fixing the image to the sheet, a discharge unit 6 for discharging the sheet with the image fixed thereto, and a sheet conveyance unit 7 configured to convey the sheet.

The image forming unit 2 includes four process cartridges 20Y, 20M, 20C, and 20B respectively configured to form images in four colors of yellow (Y), magenta (M), cyan (C), and black (B), and an exposure device 21 configured to perform exposure on the surface of the photosensitive drum 22Y described below. The four process cartridges 20Y to 20B are of the same construction except for the colors in which they form images. Thus, only the configuration of the process cartridge 20Y for forming a yellow (Y) image will be described, and a description of the process cartridges 20M to 20B will be left out.

The process cartridge 20Y includes a photosensitive drum 22Y as an image bearing member, a charging roller 23Y configured to uniformly charge the surface of the photosensitive drum 22Y, and a developing device 24Y configured to develop an electrostatic latent image for yellow with yellow toner. The sheet feeding unit 3 includes a storage cassette 30 storing sheets S, a pickup roller 31 configured to pick up the sheet S stored in the storage cassette 30, and a separation roller pair 32 configured to feed one by one the sheets picked up by the pickup roller 31.

The transfer unit 4 includes an intermediate transfer belt 40 to which the toner images on the photosensitive drums 22Y to 22B are to be primarily transferred, and primary transfer rollers 41Y, 41M, 41C, and 41B for primarily transferring the toner images on the photosensitive drums 22Y to 22B to the intermediate transfer belt 40. Further, the transfer unit 4 includes a secondary transfer roller 42 configured to secondarily transfer the toner images primarily transferred to the intermediate transfer belt 40 onto a sheet, and an intermediate transfer cleaning device 43 configured to recover any toner remaining on the surface of the intermediate transfer belt 40.

The fixing unit 5 is provided on the downstream side in the sheet conveyance direction (hereinafter, simply referred to as the "downstream side") of a secondary transfer nip N formed between the intermediate transfer belt 40 and the secondary transfer roller 42, and includes a fixing roller 51 having a built-in heater, and a pressure roller 52 held in press contact with the fixing roller 51. The discharge unit 6 is provided on the downstream side of the fixing unit 5, and includes a discharge roller pair 61 for discharging the sheet, and a discharge tray 62 on which the discharged sheets are to be stacked.

The sheet conveyance unit 7 includes a conveyance path 70 for conveying the sheet on which the image is to be formed, conveyance roller pairs 71 and 72 for conveying the sheet on the conveyance path 70, and a discharge path 73 as a first path for discharging the sheet with the image formed thereon. Further, the sheet conveyance unit 7 includes a reversing path 74 as a second path for reversing the sheet, a switching member 8 for switching the sheet conveyance paths between the discharge path 73 and the reversing path 74, and a reversing roller pair 75 configured to switch back the sheet guided to the reversing path 74. Further, the sheet conveyance unit 7 includes a two-sided conveyance path 76 for re-conveying the switched-back sheet to the conveyance path 70, and a two-sided conveyance roller pairs 77 and 78 for conveying the sheet on the two-sided conveyance path 76.

The conveyance path 70 is connected to the sheet feeding unit 3, and, on the conveyance path 70, there are arranged the secondary transfer roller 42 and the fixing unit 5 on the downstream side of the conveyance roller pairs 71 and 72. The discharge path 73 and the reversing path 74 are branched off from the conveyance path 70 at the downstream end, and the switching member 8 is provided at the branching position of the discharge path 73 and the reversing path 74. The switching member 8 as a rotatable guide portion for guiding the sheet can be switched between a first position (the position indicated by the solid line in FIG. 2) where the sheet is guided to the discharge path 73, and a second position (the position indicated by the dashed line in FIG. 2) where the sheet is guided to the reversing path 74. The switching member 8 will be described in detail below. The two-sided conveyance path 76 is connected to the reversing path 74 and the conveyance path 70.

Next, an image forming job performed by the image forming apparatus 1 will be described. In the following, a detailed description of the image forming operation in the image forming job will be omitted, and the description will center on a sheet conveyance operation in the image forming job.

When the image forming job is started in accordance with setting at an operating portion or the like, toner images of the different colors are formed on the surfaces of the photosensitive drums 22Y to 22B, and the thus formed toner images are sequentially superimposition-transferred (primarily transferred) onto the intermediate transfer belt 40. In parallel with the image forming operation, the sheets stored in the storage cassette 30 are fed one by one toward the conveyance path 70, and are conveyed to the secondary transfer nip N with predetermined timing by the conveyance roller pair 72. The sheet conveyed to the secondary transfer nip N is sent to the fixing unit 5 while the toner image primarily transferred to the intermediate transfer belt 40 is transferred to the sheet, and the image is fixed to the sheet by heating and pressing at the fixing unit 5.

When the sheet having undergone fixing is discharged onto the discharge tray 62, the switching member 8 is switched to the first position to guide the sheet to the discharge path 73, and the sheet is discharged onto the discharge tray 62 via the discharge roller pair 61. On the other hand, when image formation is performed on the second side in two-side printing, the switching member 8 is switched to the second position to guide the sheet to the reversing path 74, and the sheet is reversed through switch-backing by the reversing roller pair 75. The sheet reversed through the switch-backing is conveyed to the two-sided conveyance path 76, and is conveyed to the conveyance roller pair 72 again by two-sided conveyance rollers 77 and 78 provided in the two-sided conveyance path 76. The sheet conveyed to the conveyance roller pair 72 is conveyed to the secondary transfer nip N with predetermined timing, and the above-described operation is repeated.

Figure 3:
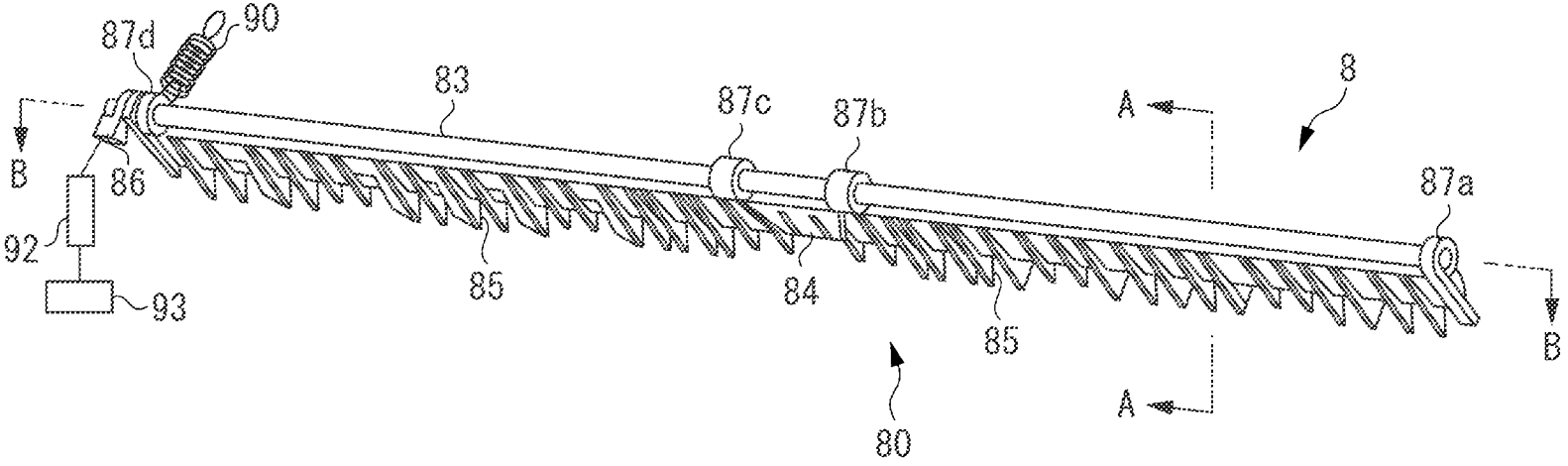
FIG. 3 is a perspective view of a switching member according to the first exemplary embodiment.
Figure 4:
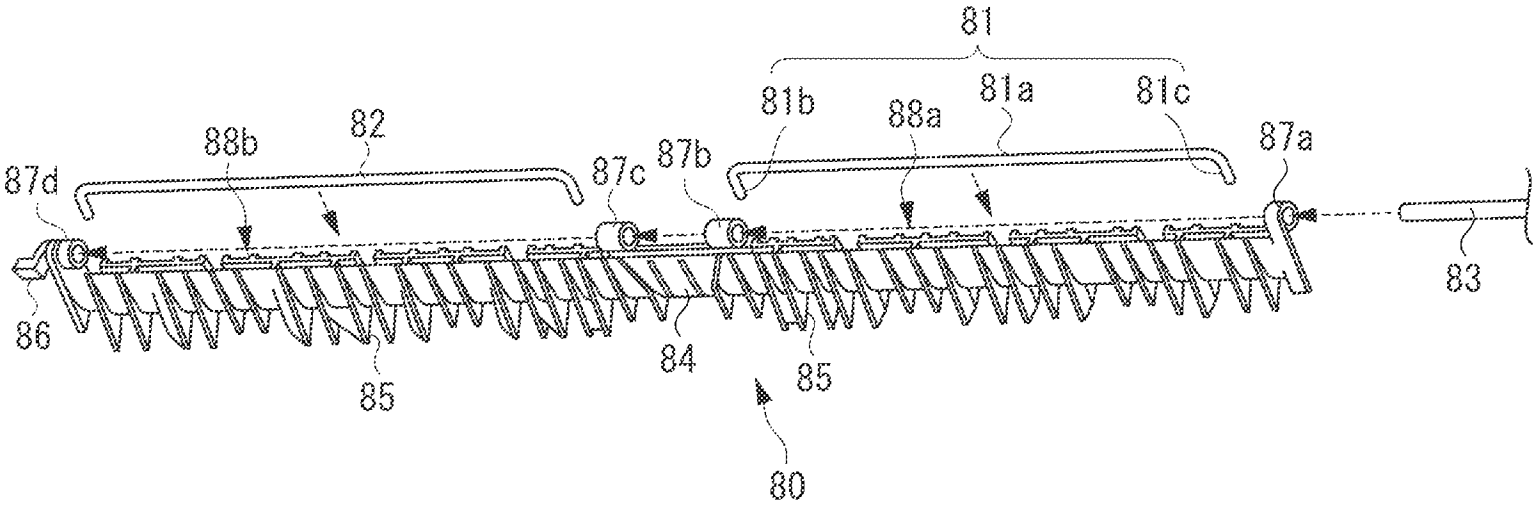
FIG. 4 is an exploded perspective view of the switching member illustrated in FIG. 3.
Figure 5:
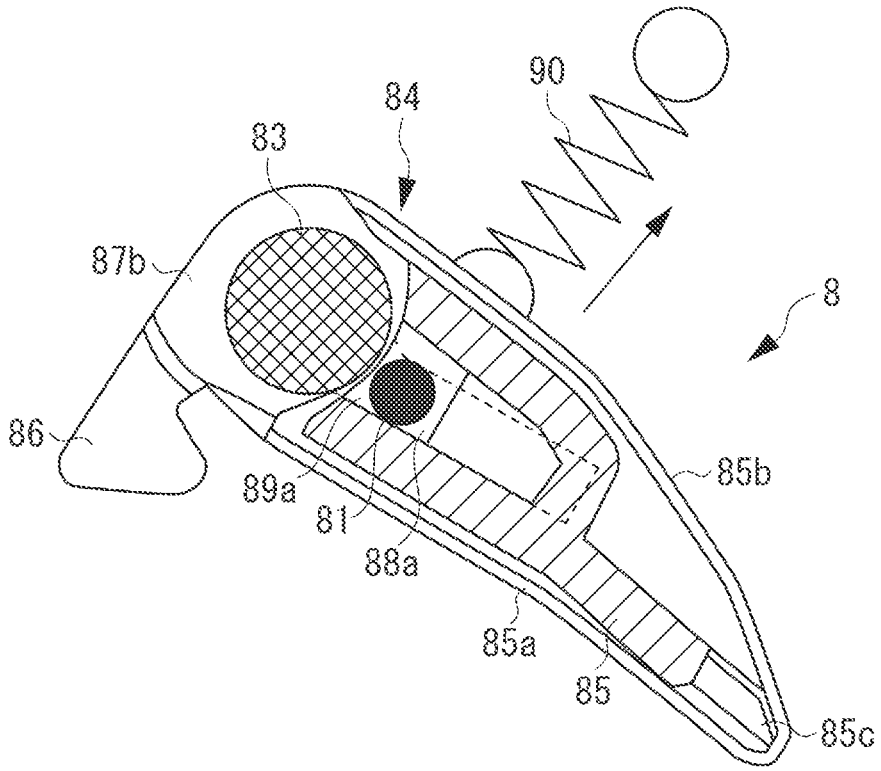
FIG. 5 is a sectional view, taken along the arrow line A-A, illustrating the internal structure of the switching member illustrated in FIG. 3.
Figure 6:
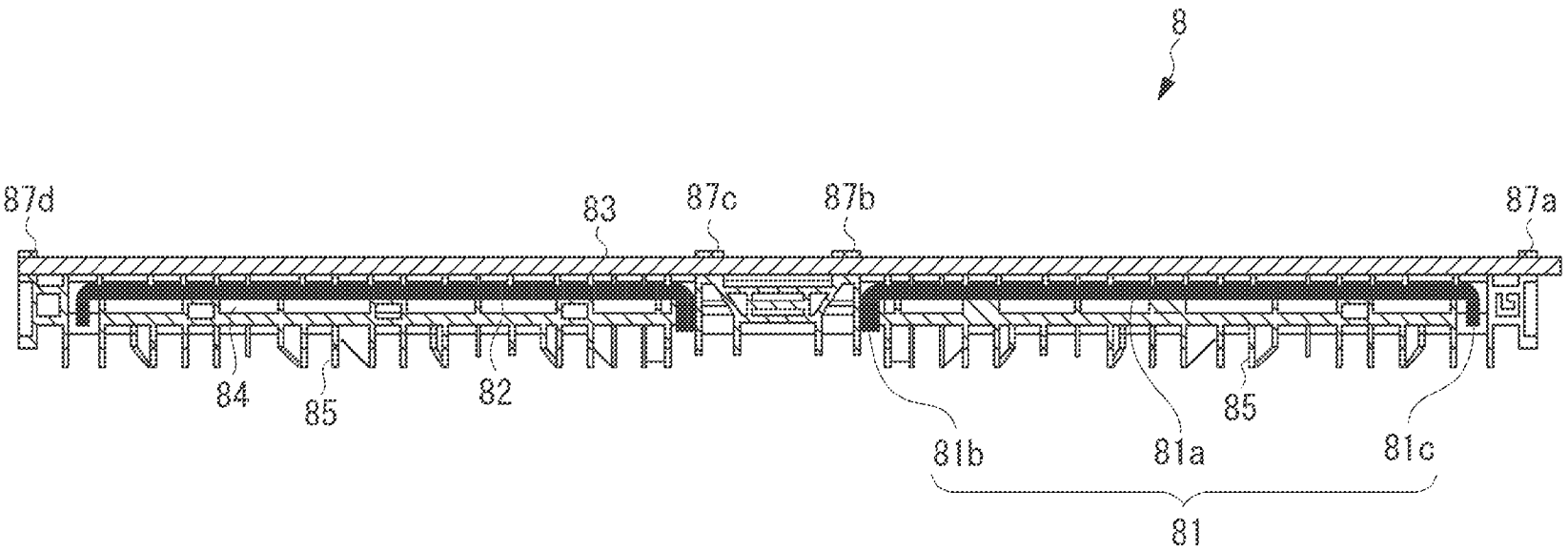
FIG. 6 is a sectional view, taken along the arrow line B-B, illustrating the internal structure of the switching member illustrated in FIG. 3.

Next, the switching member 8 for switching the sheet conveyance paths between the discharge path 73 and the reversing path 74 will be described with reference to FIGS. 2 and 3 through 6. FIG. 3 is a perspective view of the switching member 8 according to the first exemplary embodiment. FIG. 4 is an exploded perspective view of the switching member 8 illustrated in FIG. 3. FIG. 5 is a sectional view, taken along the arrow line A-A, for illustrating the internal structure of the switching member 8 illustrated in FIG. 3. FIG. 6 is a sectional view, taken along the arrow line B-B, for illustrating the internal structure of the switching member 8 illustrated in FIG. 3.

As illustrated in FIGS. 3 and 4, the switching member 8 includes a guide member 80 as a resin member made of a synthetic resin material, and reinforcing wire rods 81 and 82 reinforcing the guide member 80 and made of a columnar metal wire rod (metal member). The guide member 80 is rotatably supported by a rotational shaft 83.

The guide member 80 includes a main body 84 as a resin member main body, and a plurality of guide claws 85 formed so as to protrude from the main body 84 in a comb-teeth-like manner. The main body 84 is configured to be urged counter-clockwise around the rotational shaft 83 by an urging spring 90, and the guide claws 85 contact an abutment portion (not illustrated), whereby the main body 84 is situated at a first position. That is, the main body 84 is normally on standby at the first position.

Further, the main body 84 includes a drive input portion 86 provided at an end portion in the longitudinal direction thereof, insertion holes 87*a*, 87*b*, 87*c*, and 87*d* as insertion holes through which the rotational shaft 83 is to be inserted, and attachment openings 88*a* and 88*b* to which the reinforcing wire rods 81 and 82 are attached. The drive input portion 86 is engaged with a link member 92 connected with a solenoid 93, and is configured to rotate the main body 84 around the rotational shaft 83 in conjunction with the driving of the solenoid 93 as the drive unit for rotating the guide member 80. The main body 84 rotates in conjunction with the driving of the solenoid 93, and is situated at the second position by contacting an abutment portion 79*a*. The insertion holes 87*a*, 87*b*, 87*c*, and 87*d* are arranged side by side in the longitudinal direction so as to be aligned with the axial direction. By inserting the rotational shaft 83 as the support portion through the insertion holes, the main body 84 is supported to be rotatable with respect to the rotational shaft 83. The insertion holes 87*a* and 87*d* are provided at both end portions in the longitudinal direction of the main body 84, and the insertion holes 87*b* and 87*c* are provided substantially at the central portion in the longitudinal direction of the main body 84. The rotational shaft 83 inserted into the insertion holes 87*a*, 87*b*, 87*c*, and 87*d* is fixed to the apparatus main body. The guide member 80 includes, in the axial direction thereof, a plurality of insertion holes 87*a*, 87*b*, 87*c*, and 87*d* as supported portions rotatably supported by the rotational shaft 83.

The attachment opening 88*a* and the attachment opening 88*b* are provided in series in the longitudinal direction of the main body 84. More specifically, the attachment opening 88*a* is provided between the insertion hole 87*a* and the insertion hole 87*b*, and the attachment opening 88*b* is provided between the insertion hole 87*c* and the insertion hole 87*d*. The attachment opening 88*a* is formed so as to allow attachment of the reinforcing wire rod 81 into the interior of the main body 84 in a section between the insertion hole 87*a* and the insertion hole 87*b*. Further, as illustrated in FIG. 5, the attachment opening 88*a* is provided with a plurality of engagement claws 89*a* configured to be slightly engaged with the mounted reinforcing wire rod 81, and to regulate the movement of the mounted reinforcing wire rod 81. The attachment opening 88*b* is of the same configuration as the attachment opening 88*a*, so that the description of the attachment opening 88*a* is applied to that of the attachment opening 88*b* to left out the description thereof.

Each of the plurality of guide claws 85 includes a discharge guide surface 85*a* as a first guide surface, and a reverse guide surface 85*b* as a second guide surface. The discharge guide surface 85*a* is a guide surface for guiding the sheet to the discharge path 73 when the switching member 8 is situated at the first position. The reverse guide surface 85*b* is a guide surface for guiding the sheet to the discharge path 73 when the switching member 8 is situated at the second position. Regarding the discharge guide surface 85*a*, when the main body 84 is situated at the first position, leading end portions 85*c* of the plurality of guide claws 85 overlap a first guide 79*b* on the upstream side of the switching member 8 in a comb-teeth-like manner, whereby is smoothly connected with the first guide 79*b*. Similarly, regarding the reverse guide surface 85*b*, when the main body 84 moves to the second position, the leading end portions 85*c* of the plurality of guide claws 85 overlap a second guide 79*c* on the upstream side of the switching member 8 in a comb-teeth-like manner, whereby the reverse guide surface 85*b* is smoothly connected with the second guide 79*c*.

The reinforcing wire rod 81 as the reinforcing member prevents deformation such as warpage of the guide member 80 due to its own weight and, at the same time, corrects torsion or the like of the guide member 80. As illustrated in FIG. 6, the reinforcing wire rod 81 includes a longitudinal support shaft 81*a* as a main body portion for preventing deformation and torsion in the longitudinal direction of the guide member 80, and a pair of arm portions 81*b* and 81*c* as a pair of protrusions preventing deformation and torsion in the guiding direction of the guide member 80. When it is attached to the attachment opening 88*a*, the longitudinal support shaft 81*a* is engaged with an engagement claw 89*a*, whereby its extraction from the attachment opening 88*a* is regulated. The pair of arms 81*b* and 81*c* are formed by bending, and protrude from both ends of the longitudinal support shaft 81*a* along the sheet guiding direction in the direction orthogonal to (crossing) the longitudinal support shaft 81*a*. In the reinforcing wire rod 81, the pair of arm portions 81*b* and 81*c* of the longitudinal support shaft 81*a* are formed so as to be situated in the same plane (plane without torsion). When the reinforcing wire rod 81 is attached to the guide member 80 via the attachment opening 88*a*, the reinforcing wire rod 81 is inserted into the guide member 80 along the discharge guide surface 85*a* and the reverse guide surface 85*b*, starting with the leading ends of the pair of arm portions 81*b* and 81*c* from the rotational center side of the guide member 80.

The rotational shaft 83 is formed to be insertable into the insertion holes 87*a*, 87*b*, 87*c*, and 87*d*. When the rotational shaft is inserted into the insertion holes 87*a*, 87*b*, 87*c*, and 87*d*, the longitudinal support shaft 81*a* of the reinforcing wire rod 81 incorporated into the attachment opening 88*a* is substantially parallel to the rotational shaft 83. As illustrated in FIGS. 5 and 6, when it is incorporated into the attachment opening 88*a*, the reinforcing wire rod 81 is engaged with the engagement claw 89*a*, whereby its extraction from the attachment opening 88*a* is regulated. When the rotational shaft 83 is inserted into the insertion holes 87*a*, 87*b*, 87*c*, and 87*d*, the detachment of the reinforcing wire rod 81 is regulated more reliably by the rotational shaft 83.

The image forming apparatus 1 according to the present exemplary embodiment configured as described above provides the following effect. For example, when, to maintain the height of the image forming apparatus 1 to be low, the reversing path 74 and the two-sided conveyance path 76 situated on the upstream side of the discharge path 73 are arranged as close as possible thereto, the thickness in the longitudinal direction of the switching member 8 has also to be small. In this case, when the switching member is made of a resin material only, there is an involved variation in the leading end portion of the switch member due to shortage of rigidity, warpage, torsion, etc., of the member. Thus, the function of guiding the sheet in a stable manner may be impaired.

In contrast, in the switching member 8 of the image forming apparatus 1 according to the first exemplary embodiment, the reinforcing wire rods 81 and 82 of higher rigidity than the guide member 80 are incorporated into the guide member 80, whereby the requisite rigidity is secured and correction in configuration is effected for the switch member 80 as a whole. Thus, not only is it possible to correct, to a proper configuration, warpage, torsion or the like in terms of dimensional precision at the time of molding of the guide member 80, but also to prevent deflection due to its own weight and warpage due to the heat at the time of fixing. As a result, even in the case where the switching member 8 is formed to be thin, the switching member 8 can effect switching of the sheet conveyance path in a stable manner.

Figure 13A:
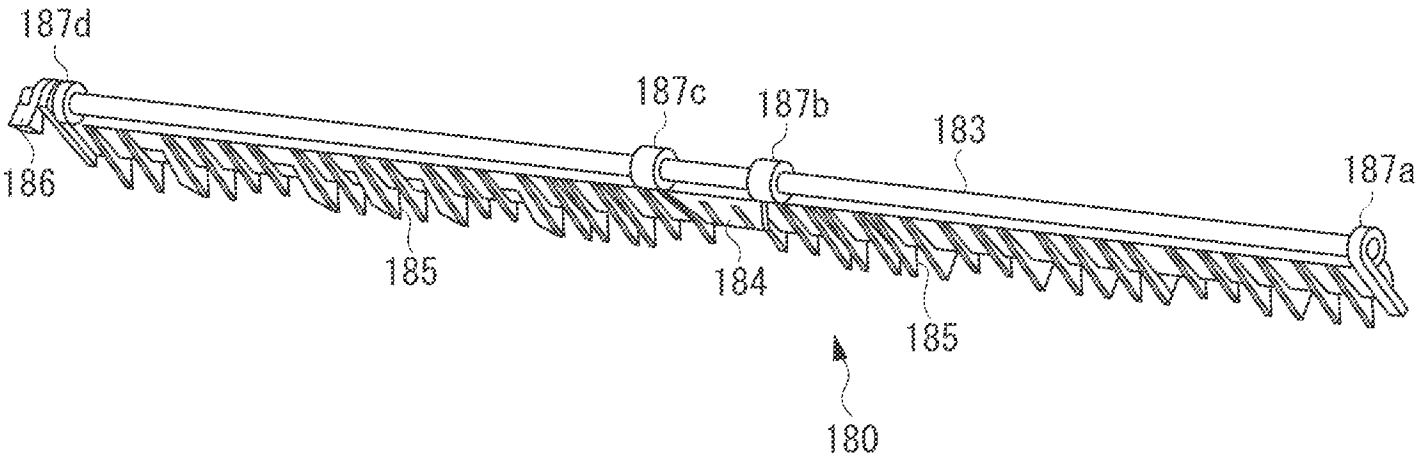
FIGS. 13A, 13B, and 13C are diagrams illustrating a comparative example of the switching member according to the present exemplary embodiment.
Figure 13B:
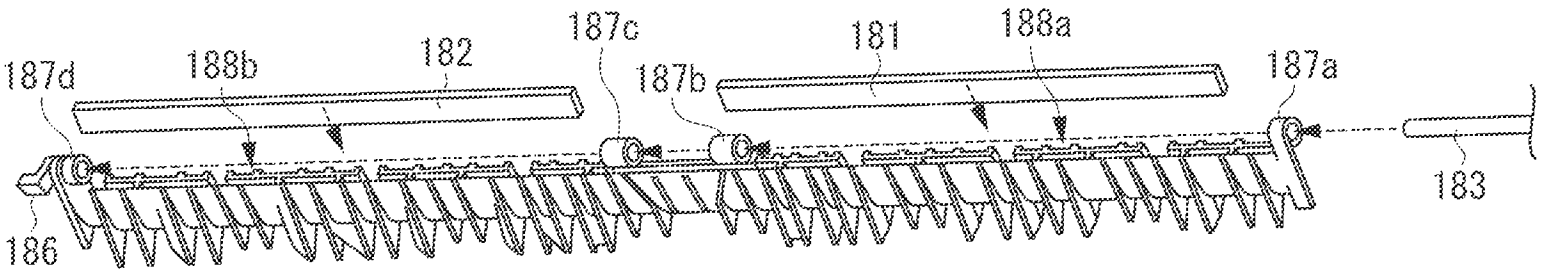
Figure 13C:
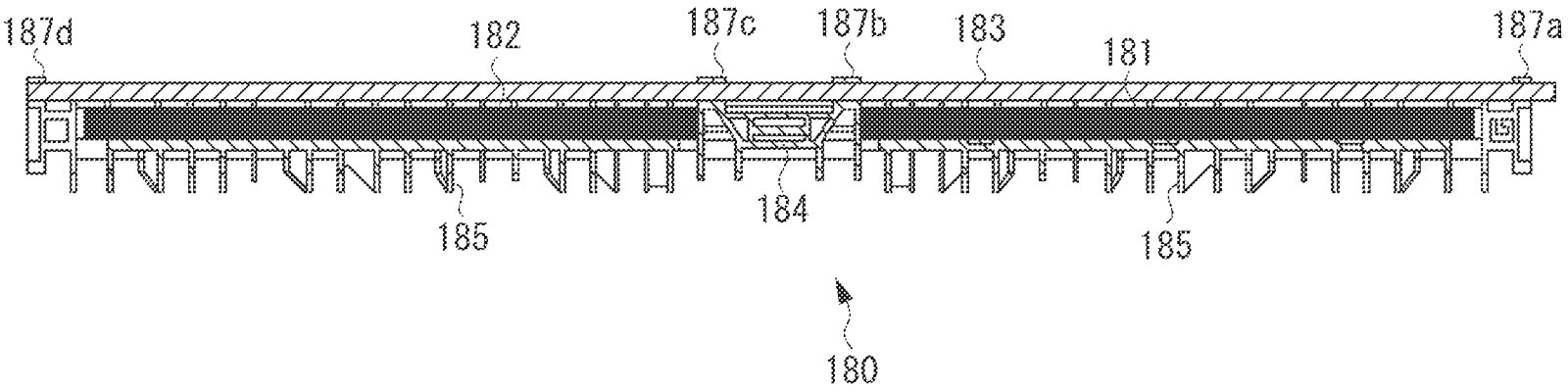

Here, as in the case of the switching member illustrated in FIGS. 13A, 13B, and 13C, the reinforcement and the correction of the switching member may also be attained by incorporating metal members 181 and 182 into the entire interior of the guide member 180. In this case, however, there are involved various problems due to an increase in the weight of the switching member as a whole. For example, the urging force of the urging spring for maintaining the standby state of the switching member increases, and it becomes necessary to increase the size of the solenoid for driving the switching operation, which may be an obstacle in achieving a reduction in size. Further, the response of the guide member is retarded with respect to the end portion at which the drive force for switching operation is input to the switching member. As a result, quick switching operation is impossible, and there is a fear of impossibility of adapting to an increase in speed. Further, in the switching operation, there is a fear of an increase in the striking sound when the guide claws contact the abutment portion.

In contrast, in the switching member 8 of the image forming apparatus 1 according to the first exemplary embodiment, the reinforcing wire rods 81 and 82 are arranged such that their center of gravity is situated on the side nearer to the rotational shaft 83 of the switching member 8 within the guide member 80 while attaining the purpose of reinforcement and correction. Thus, the weight of the leading end side of the switching member 8 scarcely increases. That is, the longitudinal support shaft 81*a*, which constitutes the major portion of the reinforcing wire rod 81, along the axis line of the switching member 8 is arranged in the vicinity of the axis side of the rotational center of the switching member 8, and the arm portions 81*b* and 81*c* protrude from the longitudinal support shaft 81*a* in the direction away from the rotational center (axis) of the switching member 8. As a result, it is possible to reduce the inertial moment of the switching member 8 accompanying the rotation while the longitudinal support shaft 81*a* and the arm portions 81*b* and 81*c* effectively prevent bending deflection, torsion, etc., of the switching member 8.

That is, there is no need to increase the urging force of the urging spring 90 for retaining the switching member 8 at the first position, and there is no need to increase the size of the solenoid performing the driving of the switching operation against the urging force of the urging spring 90. Thus, a reduction in the size of the image forming apparatus 1 is not hindered. Further, there is generated substantially no deviation in the response speed of the guide member 80 to the drive input portion 86, so that it is easier to cope with an increase in the size of the image forming apparatus 1. Further, it is also possible to suppress the striking sound when the guide claws collide with the abutment portion 79*a*.

In the first exemplary embodiment, there are used two reinforcing wire rods, and the arm portions 81*b* and 81*c*, and 82*b* and 82*c* are arranged at the center and both end portions of the switching member 8. Thus, instead of correcting the long span between both end portions in the sheet width direction with a single reinforcing wire rod, the correction is effected in shorter divided spans, whereby it is possible to attain higher correction performance on warpage, torsion, etc.

Further, on the rotational center side of the switching member 8 at the proximal end portion of the guide member 80, there are provided the attachment openings 88*a* and 88*b* for attaching the reinforcing wire rods 81 and 82 extending in the axial line direction. The reinforcing wire rods 81 and 82 are attached from the rotational center side of the switching member 8 via the attachment openings 88*a* and 88*b*. Further, while the leading end side of the switching member 8 is provided with the plurality of guide claws having guide surfaces directly guiding the sheet, no guide claw is provided at the proximal end side (rotational center side) of the switching member 8. Thus, at this portion, there are provided the attachment openings 88*a* and 88*b* for the reinforcing wire rods 81 and 82, whereby it is possible to secure the attachment openings 88*a* and 88*b* for the reinforcing wire rods 81 and 82 while maintaining the reduction in the thickness of the switching member 8. Further, the reinforcing wire rods 81 and 82 are incorporated into the attachment openings 88*a* and 88*b* of the guide member 80 from the rotational shaft side, and the rotational shaft 83 is inserted into the attachment openings 88*a* and 88*b* later on. Thus, while maintaining the easiness in assembling at the time of mass production, it is possible to prevent detachment of the reinforcing wire rods 81 and 82 even if the reinforcing wire rods 81 and 82 receive shock, vibration, etc., during shipping.

Next, an image forming apparatus according to a second exemplary embodiment of the present invention will be described with reference to FIGS. 8 through 12 as well as FIGS. 1 and 2. The image forming apparatus 1A according to the second exemplary embodiment differs from that of the first exemplary embodiment in a switching member. Thus, regarding the second exemplary embodiment, the description thereof will center on the difference from the first exemplary embodiment, i.e., the switching member, and the components that are of the same configuration as the first exemplary embodiment are indicated by the same reference numerals, and a description thereof will not be repeated.

As illustrated in FIG. 1, the image forming apparatus 1A includes the image forming unit 2, the sheet feeding unit 3, the transfer unit 4, the fixing unit 5, the discharge unit 6, and a sheet conveyance unit 7A. The sheet conveyance unit 7A includes the conveyance path 70, the conveyance roller pairs 71 and 72, the discharge path 73, the reversing path 74, a switching member 8A, the reversing roller pair 75, the two-sided conveyance path 76, and the two-sided conveyance roller pairs 77 and 78.

Figure 8:
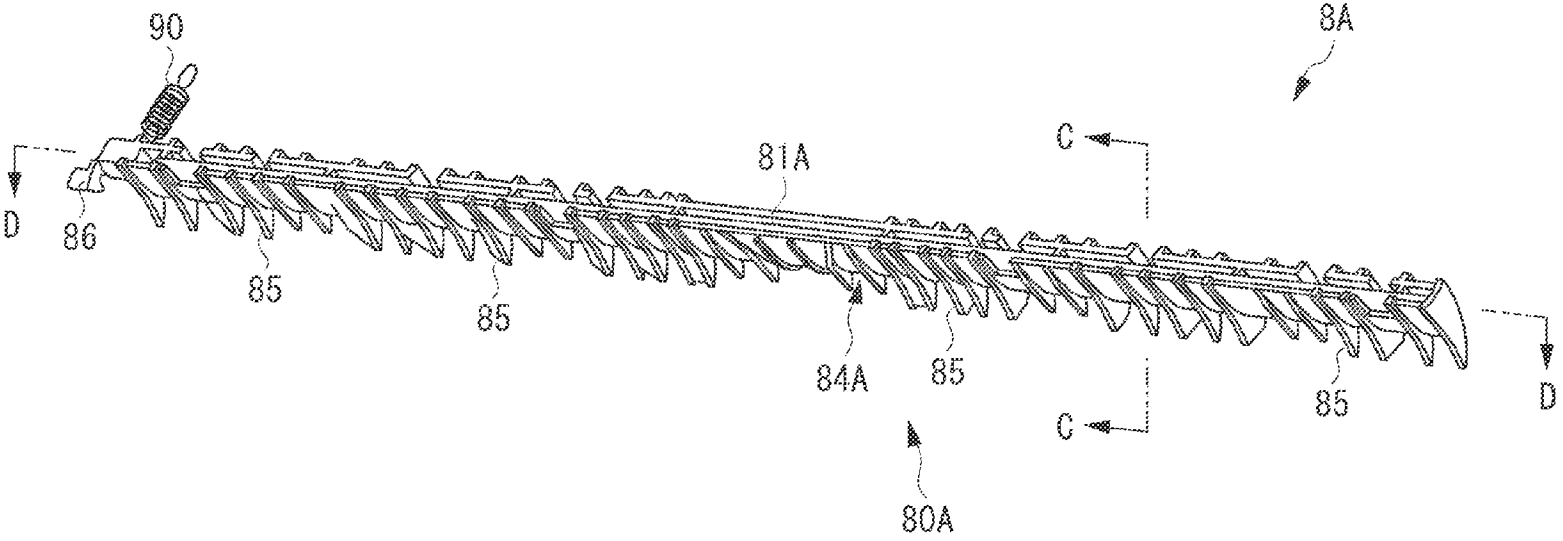
FIG. 8 is a perspective view of a switching member according to a second exemplary embodiment.
Figure 9:
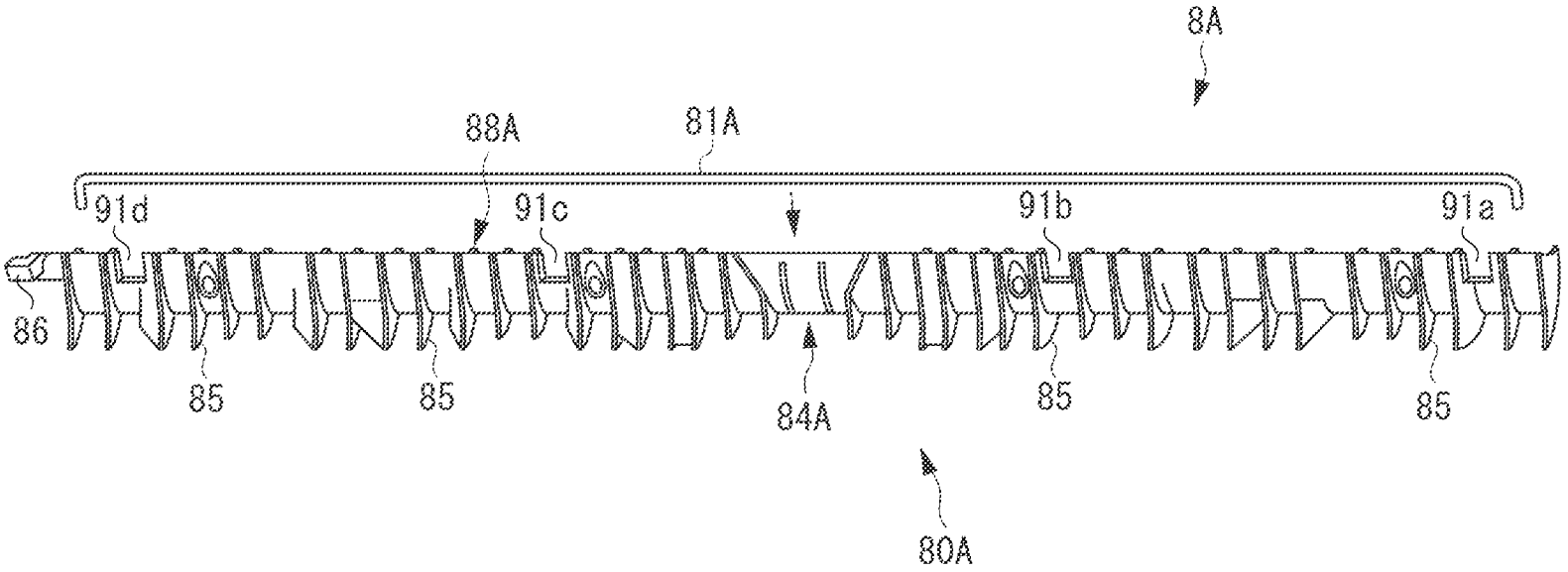
FIG. 9 is an exploded perspective view of the switching member illustrated in FIG. 8.
Figure 10:
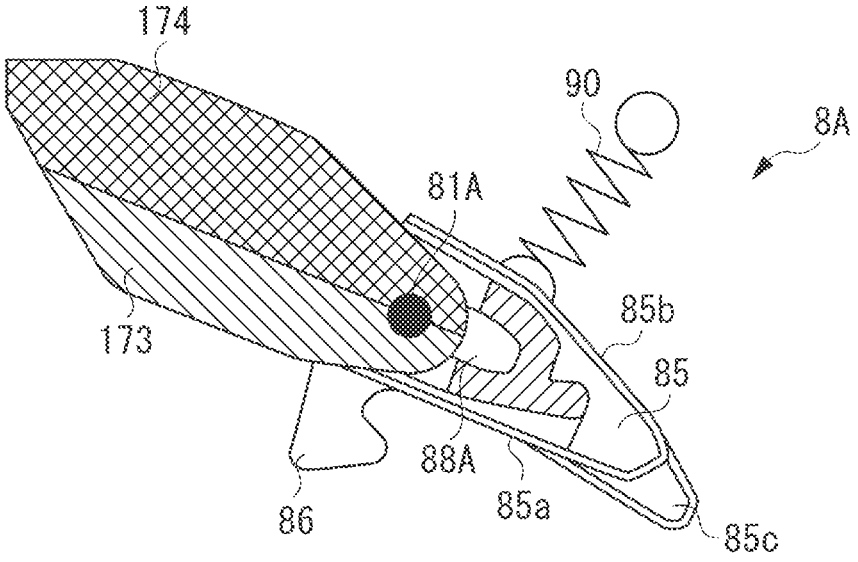
FIG. 10 is a sectional view, taken along the arrow line C-C, illustrating the internal structure of the switching member illustrated in FIG. 8.
Figure 11:
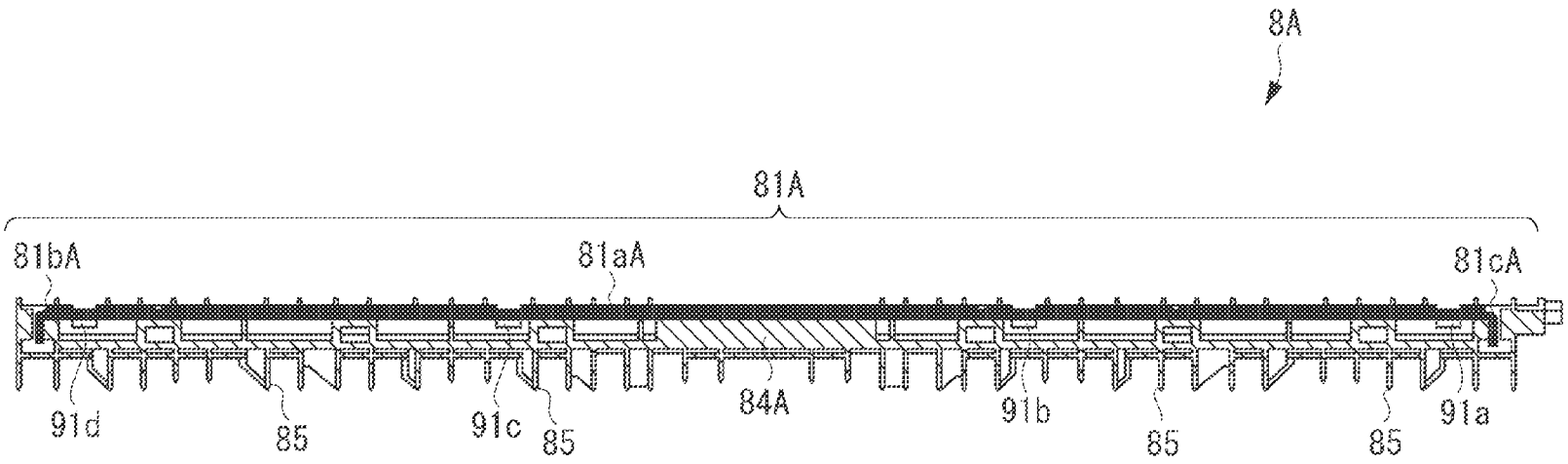
FIG. 11 is a sectional view, taken along the arrow line D-D, illustrating the internal structure of the switching member illustrated in FIG. 8.

Next, the switching member 8A for switching the sheet conveyance paths between the discharge path 73 and the reversing path 74 will be described with reference to FIGS. 8 through 11 as well as FIG. 2. FIG. 8 is a perspective view of the switching member 8A according to the second exemplary embodiment. FIG. 9 is an exploded perspective view of the switching member 8A illustrated in FIG. 8. FIG. 10 is a sectional view, taken along the arrow line C-C, for illustrating the internal structure of the switching member 8A illustrated in FIG. 8. FIG. 11 is a sectional view, taken along the arrow line D-D, for illustrating the internal structure of the switching member 8A illustrated in FIG. 8.

As illustrated in FIGS. 8 and 9, the switching member 8A includes a guide member 80A as a resin member made of a synthetic resin material, a reinforcing wire rod 81A made of a columnar metal wire rod, and the rotational shaft 83 rotatably supporting the guide member 80A.

The guide member 80A includes a main body 84A, and a plurality of guide claws 85 protruding from the main body 84A in a comb-teeth-like manner. The main body 84A is configured to be urged counterclockwise around the rotational shaft 83 by the urging spring 90, and the guide claws 85 contact an abutment portion (not illustrated), whereby the main body portion is situated at the first position. That is, the main body 84A is normally on standby at the first position.

Further, the main body 84A includes the drive input portion 86 provided at an end portion in the longitudinal direction, an attachment opening 88A to which the reinforcing wire rod 81A is attached, and a plurality of cutout portions 91*a*, 91*b*, 91*c*, and 91*d*. The attachment opening 88A is provided on the main body 84A in the longitudinal direction, and is formed so as to allow incorporation of the reinforcing wire rod 81A into the main body 84A. Further, the attachment opening 84A is provided with a plurality of engagement claws (not illustrated) configured to slightly engage with the incorporated reinforcing wire rod 81A, and to rotatably regulate the incorporated reinforcing wire rod 81A. The plurality of cutout portions 91*a*, 91*b*, 91*c*, and 91*d* are provided in series at four positions in the longitudinal direction of the main body 84A so as to expose a part of the reinforcing wire rod 81A when the reinforcing wire rod 81A is incorporated into the attachment opening 88A. As illustrated in FIG. 10, each of the plurality of guide claws 85 includes a discharge guide surface 85*a* as the first guide surface and a reverse guide surface 85*b* as the second guide surface.

The reinforcing wire rod 81A prevents deformation such as warpage of the guide member 80A due to its own weight, and corrects torsion or the like of the guide member 80A. As illustrated in FIG. 11, the reinforcing wire rod 81A includes a longitudinal support shaft 81*a*A preventing deformation, torsion, etc., in the longitudinal direction of the guide member 80A, and a pair of arm portions 81*b*A and 81*c*A provided at both ends of the longitudinal support shaft 81*a*A and configured to prevent deformation, torsion or the like in the guiding direction of the guide member 80A. When the reinforcing wire rod 81A is incorporated into the attachment opening 88A, the longitudinal support shaft 81*a*A engages with the engagement claws, thereby regulating the extraction thereof from the attachment opening 88A. The pair of arm portions 81*b*A and 81*c*A are formed by bending, and protrude from both ends of the longitudinal support shaft 81*a*A so as to extend along the sheet guiding direction. The reinforcing wire rod 81A is formed such that the longitudinal support shaft 81*a*A and the pair of arm portions 81*b*A and 81*c*A are situated in the same plane (a plane free from torsion).

Further, by the plurality of cutout portions 91*a*, 91*b*, 91*c*, and 91*d*, the reinforcing wire rod 81A is rotatably supported so as to be embraced by a discharge portion upper guide 173 and a reverse portion lower guide 174, which are fixed guide members on the downstream side of the switching member 8A.

As described above, the longitudinal support shaft 81*a*A of the reinforcing wire rod 81A reinforcing and correcting the guide member 80A is used as the rotational shaft of the switching member 8A, whereby it is possible to further reduce the inertial moment than that in the case of the switching member 8 according to the first exemplary embodiment. As a result, it is possible to enhance a reduction in size, an increase in speed, and a noise reduction of the image forming apparatus 1A.

The above-described exemplary embodiments of the present invention are not construed restrictively. Further, the effects of the exemplary embodiments of the present invention described above are solely the most conspicuous ones that can be realized by the exemplary embodiments of the present invention, and are not construed restrictively.

Figure 7:
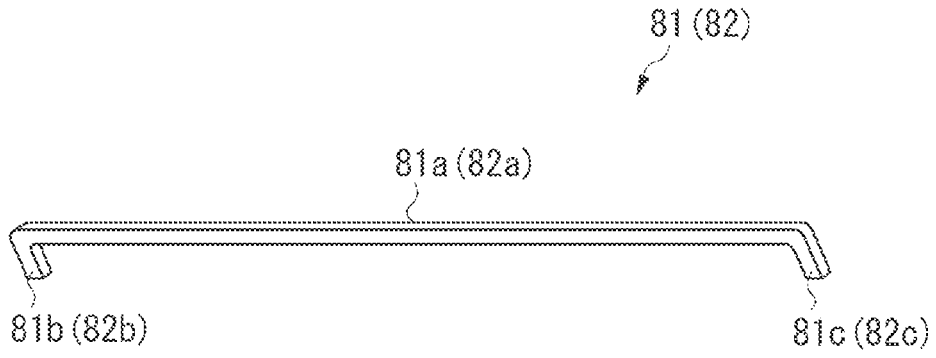
FIG. 7 is a perspective view illustrating another form of a reinforcing wire rod according to the first exemplary embodiment.

For example, while the first exemplary embodiment of the present invention employs the reinforcing wire rods 81 and 82 made of columnar metal wire rods, exemplary embodiments of the present invention are not construed restrictively. For example, as illustrated in FIG. 7, it is also possible to employ a prism-like metal wire rod as the reinforcing wire rod. Further, while the pair of arm portions 81*b* and 81*c* in the reinforcing wire rod of the above-described exemplary embodiment is formed by bending a metal wire rod, exemplary embodiments of the present invention are not construed restrictively. It is also possible, for example, for the reinforcing wire rod to be formed by press work.

Figure 12:
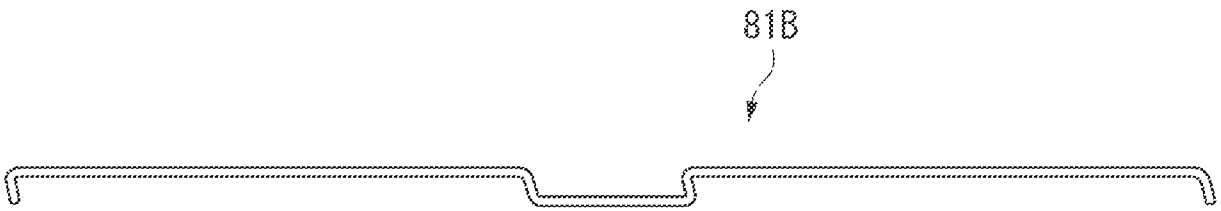
FIG. 12 is a perspective view of a reinforcing wire rod of the switching member according to the second exemplary embodiment.

Further, while the second exemplary embodiment of the present invention described above employs the reinforcing wire rod 81A having the pair of arm portions 81*b*A and 81*c*A, exemplary embodiments of the present invention are not construed restrictively. For example, as illustrated in FIG. 12, it is also possible for the reinforcing wire rod to be provided with a bent portion substantially at the central portion thereof. With the provision of the bent portion substantially at the central portion, it is possible to provide stronger correction performance on warpage and torsion in the central portion and at both end portions of the switching member.

According to the present exemplary embodiment, it is possible to provide a sheet conveyance apparatus capable of coping with an increase in speed in continuous sheet conveyance and having a switching member switching between sheet conveyance paths in a stable manner, and an image forming apparatus equipped with such a sheet conveyance apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-168144 filed Jul. 30, 2012, which is hereby incorporated by reference herein in its entirety.

What is claimed is:

1. A sheet conveyance apparatus comprising:

a first path and a second path through which a sheet is conveyed; and a guide portion rotatable between a first position where the sheet is guided to the first path and a second position where the sheet is guided to the second path, wherein the guide portion includes:

a resin member including a first guide surface configured to guide the sheet to the first path at the first position, and a second guide surface configured to guide the sheet to the second path at the second position; and a reinforcing member including a main body portion extending in a direction along an axis line of the guide portion, wherein a plurality of the reinforcing members is arranged in series in the longitudinal direction of the resin member, and wherein the reinforcing member includes protrusions provided at both end portions of the main body portion in a longitudinal direction of the main body portion, the protrusions protruding toward a direction crossing to the longitudinal direction of the main body portion.

2. The sheet conveyance apparatus according to claim 1, further comprising a shaft configured to rotatably support the resin member, wherein the main body portion is arranged in a vicinity of the shaft, and wherein a direction in which a pair of the protrusions protrudes from the main body portion is a direction away from the shaft in a direction orthogonal to the shaft.

3. The sheet conveyance apparatus according to claim 1, wherein the resin member is provided with an attachment opening for attaching the reinforcing member to the resin member.

4. The sheet conveyance apparatus according to claim 3, wherein the reinforcing member is attached to the resin member by inserting, starting with leading ends of the protrusions, the reinforcing member into the attachment openings.

5. The sheet conveyance apparatus according to claim 4, further comprising a support portion configured to rotatably support the resin member, wherein the resin member is provided with a plurality of supported portions supported by the support portion in the direction along the axis line, and wherein the attachment openings are provided between the plurality of supported portions.

6. The sheet conveyance apparatus according to claim 5, wherein the support portion includes a shaft, wherein the supported portions include insertion ports into which the shaft is to be inserted, and wherein the shaft regulates detachment of the reinforcing member from the attachment openings.

7. The sheet conveyance apparatus according to claim 1, wherein the main body portion of the reinforcing member constitutes a rotational shaft of the resin member.

8. The sheet conveyance apparatus according to claim 1, wherein the reinforcing member include protrusions provided both end portions of the main body portion in a longitudinal direction of the main body portion, the protrusions protruding toward a direction crossing to the longitudinal direction of the main body portion.

9. The sheet conveyance apparatus according to claim 1, wherein the direction which main body portion extending is crossing to the direction of the axis line of the guide portion.

10. A sheet conveyance apparatus comprising:

a sheet conveyance member configured to convey a sheet; and the conveyance guide member according to claim 1.

11. A sheet conveyance apparatus comprising:

a first path and a second path through which a sheet is conveyed; and a guide member for guiding a sheet and to be rotatable, the guide member including:

a resin member including a first surface configured to guide the sheet to the first path and a second surface configured to guide the sheet to the second path;

a connect member connected to the resin member, the connect member including an extend portion extending in a direction including a rotation axis direction of the guide member and a protruding portion protruding from the extend portion toward a direction crossing to an extending direction of the extend portion, the protruding portion protruding in an area sandwiched by the first surface and the second surface; and another connect member connected to the resin member and disposed in different position from the connect member in the extending direction, wherein the another connect member including another extend portion extending in a direction including a rotation axis direction of the guide member and another protruding portion protruding from the another extend portion toward a direction crossing to an extending direction of the another extend portion, the protruding portion protruding in an area sandwiched by the first surface and the second surface.

12. The sheet conveyance apparatus according to claim 11, wherein the guide member is arrangable in a first position and a second position, wherein in a state where the guide member is in the first position, the first surface guides the sheet to the first path, and wherein in a state where the guide member is in the second position, the second surface guides the sheet to the second path.

13. The sheet conveyance apparatus according to claim 11, wherein the protruding portion is arranged at both ends of the extend portion in an extending direction of the extend portion.

14. The sheet conveyance apparatus according to claim 11, wherein a rigidity of the connect member is higher than that of the resin member.

15. The sheet conveyance apparatus according to claim 11, wherein the guide member is driven by a drive unit.

16. The sheet conveyance apparatus according to claim 11, wherein a first surface of the resin member guides a sheet by contacting a first surface of the sheet, and a second surface of the resin member guides a sheet by contacting a second surface of the sheet which is in opposite surface of the first surface of the sheet.

17. The sheet conveyance apparatus according to claim 11, wherein the extend portion is a rotation axis of the guide member.

18. A sheet conveyance apparatus comprising:

a first path and a second path through which a sheet is conveyed; and a guide member for guiding a sheet and to be rotatable, the guide member including:

a resin member including a first surface configured to guide the sheet to the first path and the second surface configured to guide the sheet to a second path; and a wire connected to the resin member, the wire including an extend portion extending in a direction including a rotation axis direction of the guide member and a bend portion bending from the extend portion at one end of the extend portion in an extending direction of the extend portion.

19. The sheet conveyance apparatus according to claim 18, wherein the bend portion is bending from both ends of the extend portion in an extending direction of the extend portion.

20. The sheet conveyance apparatus according to claim 18, wherein the guide member is arrangable in a first position and a second position, wherein in a state where the guide member is in the first position, the first surface guides the sheet to the first path, and wherein in a state where the guide member is in the second position, the second surface guides the sheet to the second path.

21. The sheet conveyance apparatus according to claim 18, further comprising:

another wire arranged in a position different from the connect member in the extending direction and connected to the resin member, wherein said another wire including another extend portion extending in a direction including a rotation axis direction of the guide member and another bend portion bending from said another extend portion at one end of said another extend portion in an extending direction of said another extend portion.

22. The conveyance guide member according to claim 18, wherein a rigidity of the metal material forming the wire is higher than that of the resin member.

23. The conveyance guide member according to claim 18, wherein a connect member connected to the resin member, the connect member including a second extend portion extending in a direction including a rotation axis direction of the guide member, wherein the wire is arranged in an area surrounded by the second extend portion, the first surface and the second surface.

24. The sheet conveyance apparatus according to claim 23, wherein the second extend portion is a rotation axis of the guide member.

25. The sheet conveyance apparatus according to claim 18, wherein the guide member is driven by a drive unit.

26. The sheet conveyance apparatus according to claim 18, wherein a first surface of the resin member guides a sheet by contacting a first surface of the sheet, and a second surface of the resin member guides a sheet by contacting a second surface of the sheet which is in opposite surface of the first surface of the sheet.

27. The sheet conveyance apparatus according to claim 18, wherein the extend portion is a rotation axis of the guide member.

* * * * *